US006481538B2

(12) United States Patent
Blackaby et al.

(10) Patent No.: US 6,481,538 B2
(45) Date of Patent: Nov. 19, 2002

(54) ELEVATOR GUIDE RAIL MOUNTING ASSEMBLY

(75) Inventors: Barry Blackaby, Simsbury, CT (US); William Alfred Wurts, Wethersfield, CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/651,412

(22) Filed: Aug. 30, 2000

(65) Prior Publication Data

US 2002/0023805 A1 Feb. 28, 2002

(51) Int. Cl.[7] ..... B66B 7/02

(52) U.S. Cl. ..... 187/408; 187/406; 187/254; 187/266

(58) Field of Search ..... 187/408, 406, 187/254, 266

(56) References Cited

U.S. PATENT DOCUMENTS

| | | | | |
|---|---|---|---|---|
| 3,211,259 A | * | 10/1965 | Tofanelli | 187/408 |
| 3,601,938 A | * | 8/1971 | Loomis | 187/95 |
| 3,948,358 A | * | 4/1976 | Atkey | 187/95 |
| 4,431,087 A | * | 2/1984 | Karol | 187/408 |
| 4,577,729 A | * | 3/1986 | Karol | 187/95 |
| 4,664,230 A | * | 5/1987 | Olsen | 187/408 |
| 4,977,983 A | * | 12/1990 | Garrido et al. | 187/408 |
| 5,316,108 A | * | 5/1994 | Pearson | 187/95 |
| 5,469,938 A | * | 11/1995 | Biewald et al. | 187/408 |
| 5,520,264 A | * | 5/1996 | Korhonen | 187/408 |
| 6,012,554 A | * | 1/2000 | Ito et al. | 187/406 |

FOREIGN PATENT DOCUMENTS

| | | | | |
|---|---|---|---|---|
| EP | 0 643 007 A2 | | 3/1995 | B66B/7/02 |
| JP | 59-153782 | | 9/1984 | B66B/7/02 |
| JP | 401256484 | * | 10/1989 | |
| JP | 402286585 | * | 11/1990 | |
| JP | 3-73781 | * | 3/1991 | |
| JP | 4-272078 | * | 9/1992 | |
| JP | 405229766 | * | 9/1993 | 187/408 |

* cited by examiner

*Primary Examiner*—Robert P. Olszewski
*Assistant Examiner*—Steven B. McAllister

(57) ABSTRACT

An elevator system includes a mounting device that facilitates more readily installing guide rails within a hoistway and supporting the elevator cab and counterweight on the same rails. A plurality of mounting devices are used along the length of the hoistway. Each mounting device includes a first mounting bracket that preferably is secured directly to a selected wall within the hoistway. A second mounting bracket is secured to the first mounting bracket. The position of the second mounting bracket relative to the first is selectively adjusted. The second mounting bracket includes support portions for supporting the guide rails within the hoistway. The support portions on the second bracket have a fixed distance between them to facilitate maintaining an accurate distance between the guide rails throughout the hoistway.

13 Claims, 3 Drawing Sheets

ELEVATOR GUIDE RAIL MOUNTING ASSEMBLY

BACKGROUND OF THE INVENTION

This invention generally relates to a system for supporting an elevator within a hoistway. More particularly, this invention relates to an arrangement for installing and supporting guide rails for an elevator system that supports an elevator cab and counterweight on the same rails.

Typical elevator systems include a car that moves within a hoistway between landings at different levels of a building. A counterweight typically is also provided that moves within the hoistway. In conventional arrangements, the counterweight and elevator cab have been supported using separate sets of guide rails within the hoistway.

Regardless of the arrangement of the cab or counterweight, the task of installing and supporting guide rails within a hoistway has been cumbersome. The number of plumb lines and the methods of supporting the guide rails within the hoistway that have been required introduce complexity and expense during the installation process.

One challenge faced by elevator installers is maintaining proper alignment of the guide rails during the installation process. The distance between the guide rails must be set accurately along the entire length of the hoistway or undesirable vibration during elevator cab travel may occur.

There are a variety of other challenges that face elevator installers and those skilled in the art are constantly striving to improve the process. This invention addresses the need for an improved system for supporting an elevator within a hoistway that greatly simplifies the installation process.

SUMMARY OF THE INVENTION

In general terms, this invention is a device for supporting guide rails for an elevator system within a hoistway. The inventive device is designed such that the elevator car and the elevator counterweight ride on the same guide rail structure. Mounting brackets and guide rails are positioned so that the car and counterweight run on portions of a common guide rail shape thus eliminating the need for separate car and counterweight guide rails.

The inventive device includes a first bracket that is secured to a wall within the hoistway. A second bracket is mounted to the first bracket such that the position of the second bracket can be adjusted in at least one direction. The second bracket includes support portions that provide a support surface for supporting the guide rails within the hoistway. The support portions on the second bracket provide a fixed distance between the guide rails that remains constant throughout the hoistway.

The various features and advantages of this invention will become apparent to those skilled in the art from the following detailed description of the currently preferred embodiments. The drawings that accompany the detailed description can be briefly described as follows.

DETAILED DESCRIPTION OF THE PREFERRED EMBODIMENT

Figure 1:
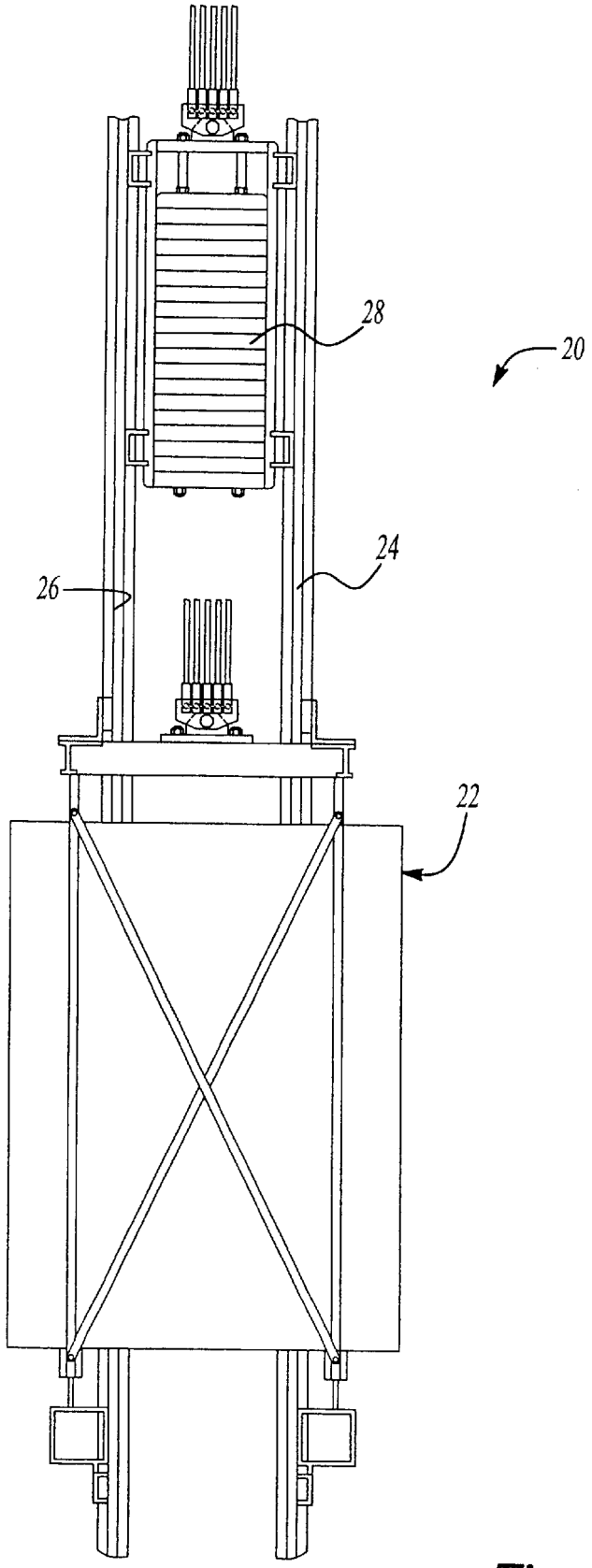
FIG. 1 schematically illustrates an elevator system designed according to this invention.

An elevator system 20 is schematically illustrated in FIG. 1. An elevator cab 22 moves through a hoistway (not specifically illustrated) along guide rails 24 and 26. A counterweight 28 also moves within the hoistway along the same guide rails 24 and 26. A significant advantage provided by this invention is the ability to support the cab 22 and the counterweight 28 on the same rails.

Figure 2:
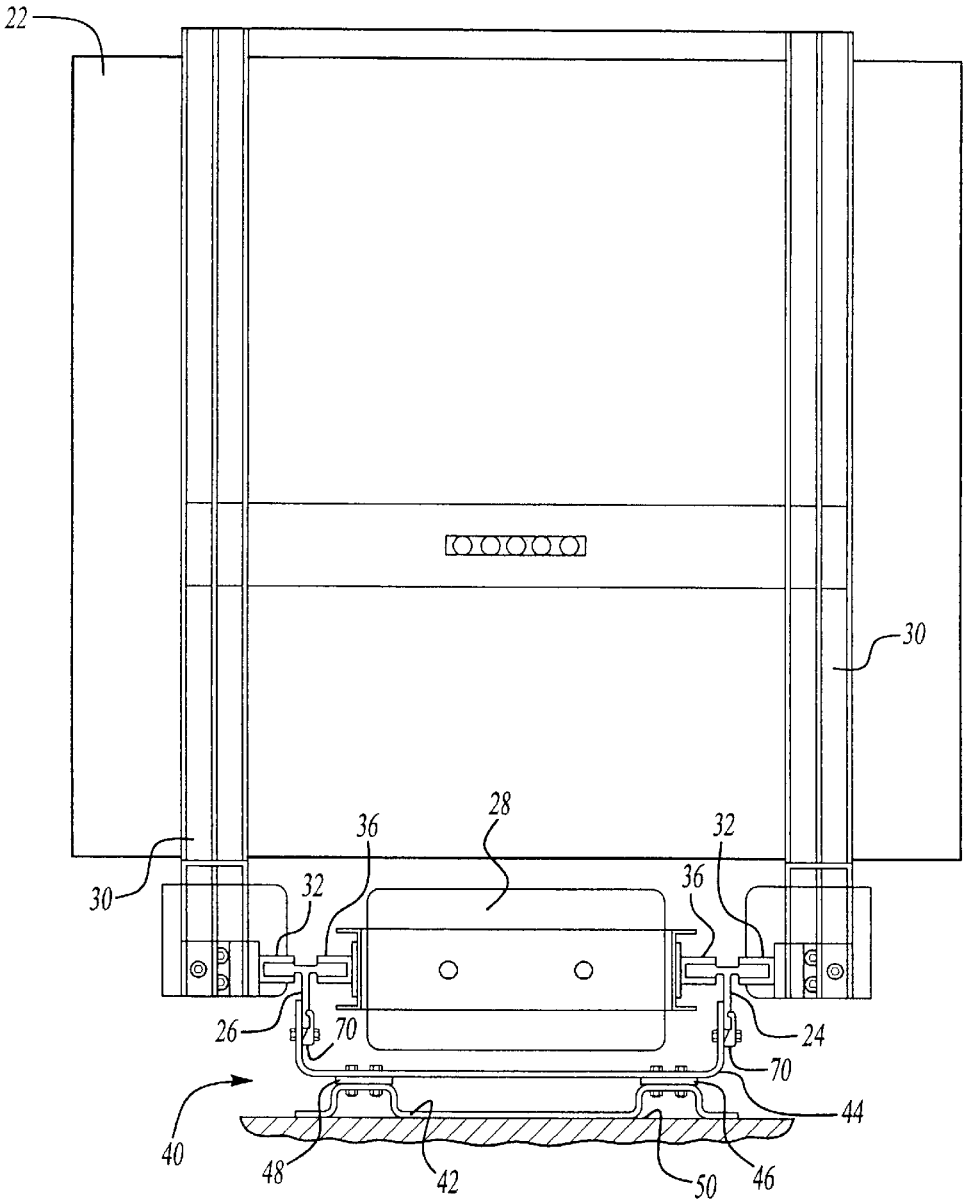
FIG. 2 is another view showing more details of the inventive device for supporting guide rails within an elevator system designed according to this invention.

As best seen in FIG. 2, the elevator cab 22 preferably is supported by a conventional support assembly 30, which facilitates the elevator cab 22 moving along the rails 24 and 26. Conventional guides 32, which can be slide guides or roller guides, provide the interface between the support structure 30 and the rails 24 and 26.

A similar set of guides 36 allow the counterweight 28 to move along the rails 24 and 26 as needed.

The elevator system 20 includes a mounting device 40 that supports the guide rails 24 and 26 within the hoistway. The mounting device 40 includes a first bracket 42 that preferably is secured directly to a chosen one of the hoistway walls. In the inventive arrangement, a plurality of the mounting devices 40 are provided along the hoistway. In one example, one mounting device 40 is associated with each level in the building. In other words, there preferably are at least as many mounting devices 40 as there are landings along the hoistway.

The first bracket 42 can be secured to the hoistway wall 50 using conventional fasteners such as bolts or concrete anchors, depending on the particular structure where the elevator system is installed.

A second bracket 44 is mounted to the first bracket 42. Preferably shims 46 and 48 are provided at two interface points between the first bracket 42 and the second bracket 44. The shims 46 and 48 allow for the position of the second bracket 44 to be adjusted relative to the first bracket 42. Because the first bracket 42 is attached directly to a hoistway wall, adjusting the position of the second bracket 44 relative to the first bracket 42 allows for adjusting the position of the support device 40 relative to the hoistway wall. As those skilled in the art will appreciate, hoistway walls are not necessarily true or plumb along the entire length of the hoistway and some adjustment may be necessary to maintain a desired alignment of the elevator support components.

Figure 3:
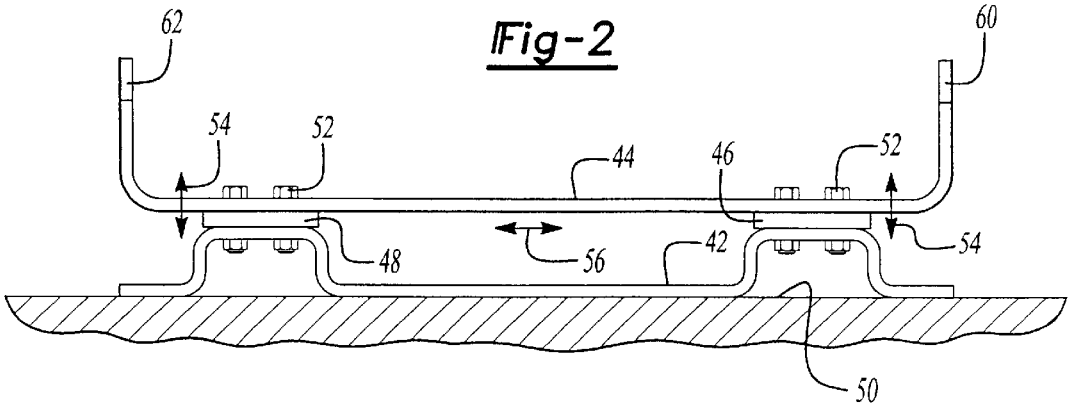
FIG. 3 diagrammatically illustrates a preferred embodiment of a mounting device designed according to this invention.

The second bracket 44 preferably is secured to the first bracket 42 using fasteners such as bolts 52. The adjustability of the bolts 52 and the use of the shims 46 and 48 allow for adjustment as schematically shown in FIG. 3 by the arrows 54. The first bracket 42 preferably includes an arrangement that allows adjustment along the hoistway wall 50 in the direction schematically shown by the arrows 56.

The second bracket 44 includes two support ends 60 and 62, respectively. A distance between the support ends 60 and 62 remains fixed because of the structure of the second bracket 44. Therefore, the distance between the guide rails at the location of the mounting device 40 is constant.

Provided that the plurality of mounting devices 40 are appropriately aligned within the hoistway, the distance between the guide rails 24 and 26 remains constant throughout the hoistway. Adjusting the positions of the support ends 60 and 62 on each bracket 44 aligns the guide rail positions throughout the hoistway. This invention greatly simplifies the installation of guide rails because it eliminates the need to continuously monitor and adjust the distance between the guide rails. Using this invention allows for a simplified adjustment that is made upon installation of the mounting devices 40. Once the support ends 60 and 62 of each second bracket 44 are aligned, the alignment of the guide rails 24 and 26 and the distance between them is easily maintained as desired.

Figure 4A:
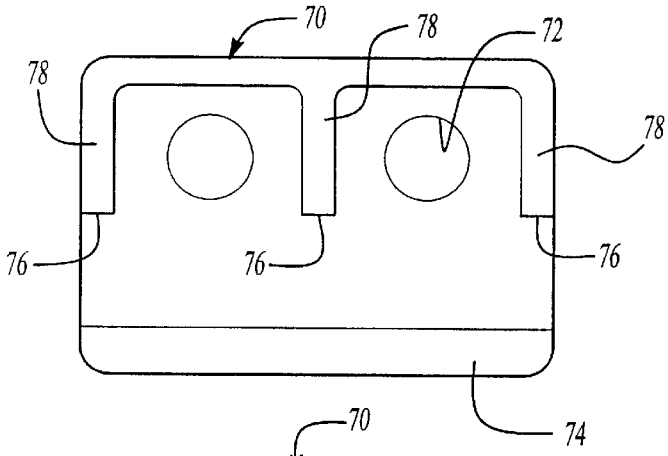
FIGS. 4*a* and 4*b* illustrates a portion of the inventive mounting device.
Figure 4B:
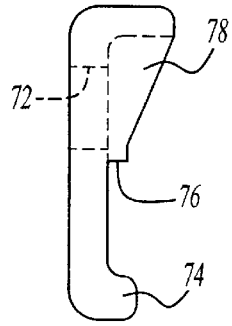

The guide rails 24 and 26 preferably are supported on the support ends of the second bracket 44 using at least one clip 70 at each interface between a guide rail and the second bracket 44. FIGS. 4*a,* 4*b* and 6 diagrammatically illustrate a preferred embodiment of such a clip 70. A set of openings 72 are provided for bolting or otherwise fastening the clip 70 to the second bracket 44. A projection 74 preferably is provided at one end of the clip 70. A plurality of support surfaces 76 preferably are provided near a midpoint of the clip 70 on the end of web portions 78.

Figure 5:
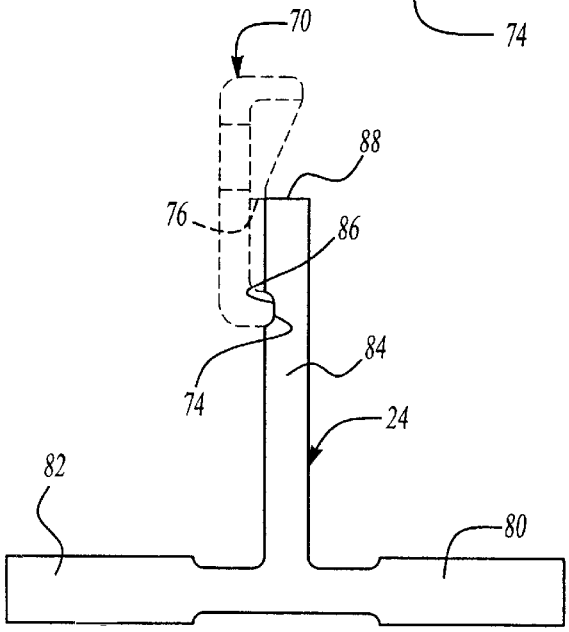
FIG. 5 illustrates the function of the component illustrated in FIGS. 4*a* and 4*b* interacting with a guide rail.
Figure 6:
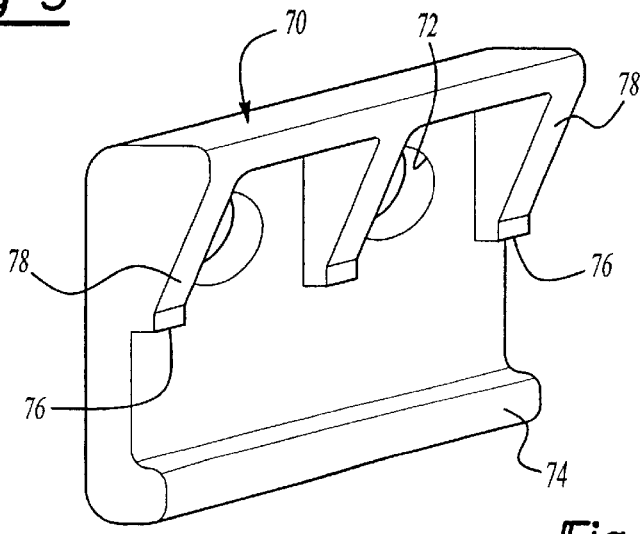
FIG. 6 is a perspective view of the preferred embodiment of the component shown in FIGS. 4*a,* 4*b* and 5.

As best seen in FIG. 5, the guide rails (guide rail 24 is illustrated, for example) preferably include a first portion 80 that accommodates the guides 32 and a second portion 82 that accommodates the guides 36. A third portion 84 is supported by the second bracket 44 cooperating with the clips 70. The projection 74 on the clip 70 preferably is received within a corresponding groove 86 on the third portion 84 of the guide rail 24. The support surface 76 preferably engages an end 88 on the guide rail portion 84. The engagement between the support surface 76 and the end 88 prevents undesirable rotation of the guide rail relative to the support device second bracket 44. As can be appreciated by those skilled in the art, different thicknesses of the portion 84 of the guide rail are possible. Further, the depth of the groove 86 may vary depending on the design of a particular elevator system. Moreover, manufacturing tolerances may allow for some deviation along the length of a guide rail or different portions of a guide rail, for example.

The web portions 78 and the support surfaces 76 engage the end 88 on the guide rail to prevent the guide rail from rotating about the interface between the projection 74 and the groove 86 while the clip 70 is tightly secured to the second bracket 44. It is important to maintain a straight alignment of the guide rails relative to the second bracket 44.

When the clips 70 secure the guide rails relative to the second bracket 44, the guide rails are restricted from moving outward away from the wall 50 or in a horizontal direction generally parallel to the wall 50. The guide rails 24 and 26, however, preferably are not restricted from moving in a longitudinal direction along their length relative to the mounting brackets 44. Such movement is required to accommodate settling of a building after an elevator installation is complete and to accommodate for metal expansion and contraction due to temperature changes, for example.

Of course, different rail, clip and guide configurations are useful within a system designed according to this invention. Those skilled in the art who have the benefit of this description will be able to chose component designs to meet the needs of a particular situation.

An elevator system is more easily installed using mounting devices 40 designed according to this invention because it simplifies the task of aligning the guide rails and maintaining an accurate distance between the guide rails along the length of the hoistway. Additionally, using a single set of rails to support the cab 22 and the counterweight 28 renders the system more economical. The number of plumb lines and measurements required by an installer using a system designed according to this invention is greatly reduced compared to conventional arrangements. In one example, the alignment measurements are reduced by 50%. Additionally, the inventive arrangement eliminates any need for setting or aligning separate counterweight rails.

Another advantage to this invention is that it reduces the amount of material required to accurately and adequately support the guide rails within the elevator hoistway. In one example, the amount of steel required to install the elevator system is reduced by 50%. The reduction in labor and material costs associated with this invention are substantial compared to previous systems.

The preceding description is exemplary rather than limiting in nature. Variations and modifications to the disclosed embodiments may become apparent to those skilled in the art that do not necessarily depart from the spirit or scope of this invention. The scope of legal protection given to this invention can only be determined by studying the following claims.

We claim:

1. A device for supporting at least 2 guide rails within an elevator hoistway, comprising:

a plurality of first bracket members adapted to be secured at spaced vertical intervals to a hoistway wall;

a plurality of second bracket members, each secured to a different one of the first bracket members, each second bracket member supporting the at least two guide rails and having at least two free support ends projecting away from the first bracket member and immovably positioned relative to a remainder of the second bracket member for supporting the at least 2 guide rails, the support ends having a fixed distance between them; and a clip member associated with each support end, the clip members and support ends cooperating to maintain each guide rail in a desired position in which a guide portion of the guide rail is spaced farther than the support end from the hoistway wall.

2. The device of claim 1, including insert members between the first and second bracket members.

3. The device of claim 1, wherein each clip member includes a support surface that is adapted to engage an end on a guide rail to maintain an alignment with the support end.

4. An elevator system, comprising:

a plurality of guide rails each having a guide portion; and a plurality of mounting devices located at spaced vertical intervals within a hoistway, each mounting device including a first bracket portion adapted to be secured to a hoistway wall, a second bracket portion secured to the first bracket portion the second bracket portion supporting the plurality of guide rails and having free support ends projecting away from the first bracket portion and immovably positioned relative to a remainder of the second bracket portion, and a clip member associated with each support end, the clip members and support ends cooperating to support the guide rails with the guide portions of the guide rails spaced farther than the support ends from the hoistway wall and to maintain a fixed distance between the guide rails.

5. The system of claim 4, including insert members between the first and second bracket members.

6. The system of claim 4, wherein each clip member includes at least one support surface that engages an end on a corresponding guide rail and maintains the guide rail in a desired alignment with the second bracket member.

7. The system of claim 6, wherein each clip member includes a plurality of web portions each having a support surface.

8. The system of claim 6, wherein each guide rail includes a receiver portion that receives an end portion of at least one of the clip members.

9. The system of claim 4, including a cab portion and a counterweight and wherein the cab portion and counterweight are supported on the same guide rails.

10. A method of installing guide rails in an elevator hoistway, comprising the steps of:

(A) securing a plurality of first bracket members at spaced vertical intervals to a single wall in the hoistway;

(B) securing a second bracket member, which has free support ends that are immovable relative to a remainder of the second bracket member, to each first bracket member so that the support ends project away from the first bracket member;

(C) aligning the support ends of the second bracket members; and (D) securing at least two of said guide rails to each second bracket member using clip members associated with the support ends so that guide portions of the guide rails are spaced farther than the support ends from the single wall.

11. The method of claim 10, including supporting an elevator cab and a counterweight on the same rails.

12. The system of claim 8, wherein each clip member includes a stop surface that abuts a corresponding surface on a corresponding one of the guide rails such that there is no relative rotation between the guide rails and the support ends.

13. The system of claim 6, wherein each clip member and each support end cooperates with a corresponding one of the guide rails to restrict relative movement between the guide rails and the support end in at least two directions while permitting relative movement in a third direction.

* * * * *